United States Patent [19]

Bernardo et al.

[11] 4,056,909

[45] Nov. 8, 1977

[54] SURFACE WATERSTOPS

[75] Inventors: Gerald Bernardo, Henlow Village; Richard Malcolm Clive Jackson, Cinderford, both of England

[73] Assignee: Schlegel (U.K.) Limited, Leeds, England

[21] Appl. No.: 631,047

[22] Filed: Nov. 12, 1975

Related U.S. Application Data

[63] Continuation of Ser. No. 509,303, Sept. 25, 1974, abandoned.

[51] Int. Cl.[2] ..... E04B 1/68; B32B 3/30

[52] U.S. Cl. ..... 52/396; 52/573; 404/61; 404/68

[58] Field of Search ..... 52/396, 573, 396; 404/61, 62, 68, 69

[56] References Cited

U.S. PATENT DOCUMENTS

| | | | |
|---|---|---|---|
| 1,454,859 | 5/1923 | Raw | 52/589 |
| 2,937,065 | 5/1960 | Harza | 52/396 |
| 3,583,120 | 6/1971 | Wangerow | 52/396 |

FOREIGN PATENT DOCUMENTS

| | | | |
|---|---|---|---|
| 1,309,406 | 10/1962 | France | 52/396 |
| 775,558 | 5/1957 | United Kingdom | 52/396 |

*Primary Examiner*—James L. Ridgill, Jr.
*Attorney, Agent, or Firm*—Cumpston & Shaw

[57] ABSTRACT

A surface waterstop is in the form of a strip of rubber or plastics material. At least one keying formation, preferably a T-shaped formation, is provided on each side of a center line of the strip. A longitudinally-extending central section may be provided for receiving and locating stop-end shuttering. Along at least one lateral edge, and preferably along both lateral edges, the strip is adapted, for example by the provision of holes, slots or the like, to receive fixing pins or clips which, in use, extend at an acute angle to the surface on which the waterstop is laid.

10 Claims, 5 Drawing Figures

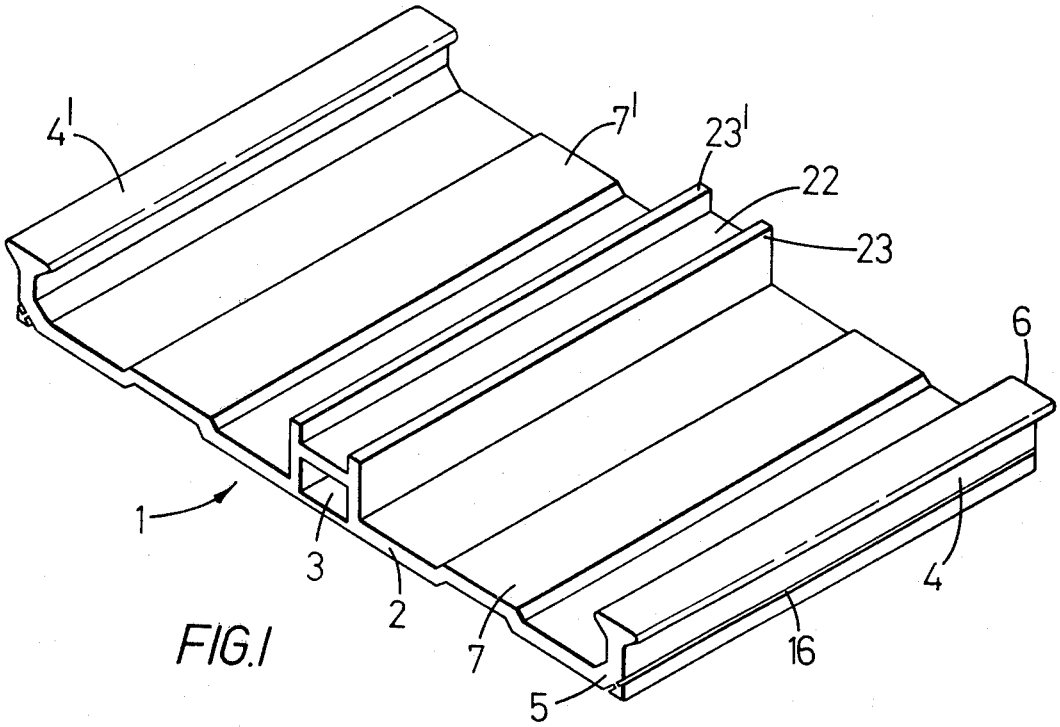
FIG.1
FIG.2
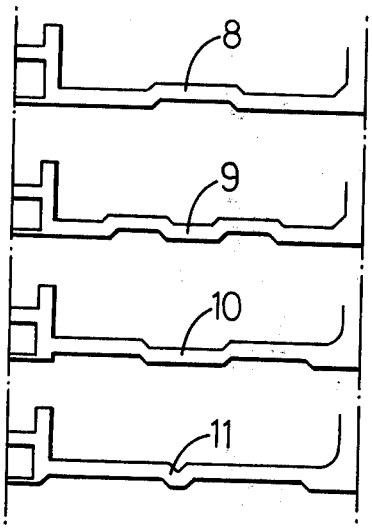
FIG.3
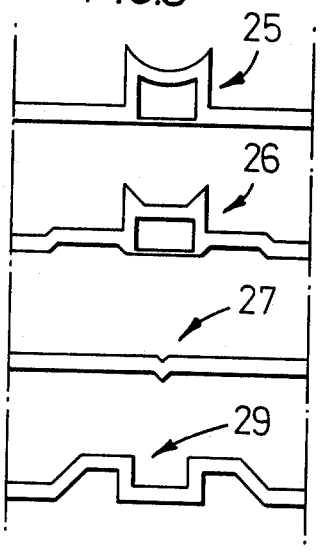
FIG.4
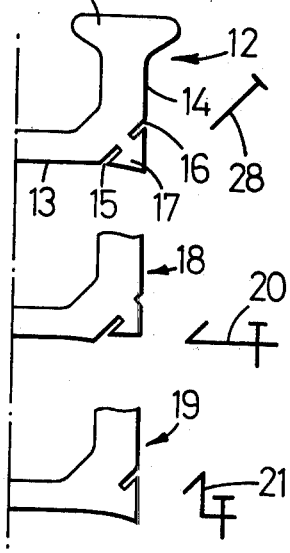

SURFACE WATERSTOPS

This is a continuation, of application Ser. No. 509,303, filed Sept. 25, 1974, now abandoned.

This invention relates to surface waterstops and in particular to waterstops which are intended for nailing or otherwise being secured to shuttering during the forming of a concrete joint. The invention also relates to a method of sealing a joint with a waterstop.

Surface waterstops extend across a surface of a joint to be sealed and comprise a strip of rubber or plastics material, usually extruded polyvinyl chloride, having at least one keying formation on each side of a centre line of the strip. The keying formations extend from the strip into the concrete poured to form the joint and normally broaden out from their root to provide a good key with the concrete.

Because the joint is formed in two parts at different times, the second part normally after the first has set, the waterstop may have an upstanding central portion with which to align stop-end shuttering extending at right angles to the joint surface.

In most constructions of joint, it is necessary to affix the waterstop to a surface providing shuttering for the concrete of the joint and in the case of vertical surfaces it is essential firmaly to secure the waterstop to the surface.

It is known to provide surface waterstops with blind holes to receive nails and in these known constructions, the holes are formed either directly through the keying formation or through an extension of the strip laterally of the keying formation. In both cases the holes are such that the nails must be driven at right angles to the surface of the strip into the surface of the shuttering.

Normally, the nails are not fully driven home in the waterstop so that the head of the nail can key with the concrete and thus minimise the danger of the waterstop being pulled off along with the shuttering. However this does mean that the waterstop tends to ride up the shank of the nail, thus allowing the waterstop to lift from the shuttering surface, with the result that loose aggregate and fines may work their way behind the waterstop. To prevent this, double-headed nails may be used, but these are expensive.

According to the present invention, we provide a surface waterstop in the form of a strip of rubber or plastics material having at least one keying formation on each side of the centre line of the strip and in which at least one lateral edge of the strip is adapted to receive fixing pins or clips, which, in use, extend at an acute angle to a surface on which the waterstop is laid.

Preferably both edges are adapted to receive fitting pins or clips at an angle of 20° – 70°, preferably 30° – 60° for example 45°, at the surface and preferably a slot is provided in each edge for this purpose. In a particularly preferred embodiment, adjacent surfaces of a lateral bottom corner of the strip are provided with collinear slots extending longitudinally at 45° to the bottom surface of the strip so that any nail driven through both slots enters the surface at an angle of 45°. It is envisaged that the slots could be replaced by a plurality of blind holes making an acute angle with the said surface.

The waterstop strip may also include a central section with locating means for stop-end shuttering. In a preferred embodiment of this type, the central section projects from a face of the strip on the same side as the keying formations and includes two edge flanges, the stop-end shuttering being located between the flanges.

The edge flanges of the central section may also act as a grout seal to prevent leakage of a first pour of concrete from one side of the stop-end shuttering to the other.

The keying formations are normally of a section which broadens from the root to the top of the formation and may for example be of generally T-shaped section or of inverted triangular section.

Also according to the invention there is provided a method of making and sealing a joint in a concrete structure with a waterstop in the form of a strip of rubber or plastics material having at least one keying formation on each side of a centre line of the strip and upstanding from one face of the strip comprising the steps of (a) placing the other face of the strip in position on a surface of the structure or a shuttering surface, (b) securing the strip to the surface by means of nails or fixing pins extending into or through an edge of the strip at an acute angle to the surface, (c) placing stop-end shuttering against a centre portion of the strip, (d) pouring a first mass of concrete on one side of the stop-end shuttering to key with the keying formation on one side of the strip and (e) pouring a second mass of concrete to key with the keying formation on the other side of the strip.

Normally, the stop end shuttering is removed after the first mass of concrete has set and prior to pouring the second mass.

The invention thus provides a very secure fixing for the strip as the strip is unable to ride up the shaft of the nails or fixing pins.

Preferred embodiments of the invention are now described with reference to the accompanying drawings, in which:

FIG. 1 shows a perspective view of a length of waterstop,

FIG. 2 shows detail end views of web portions of various waterstops,

FIG. 3 shows detail end views of central portions of various waterstops,

FIG. 4 shows detail end views of edge portions of various waterstops adapted to receive fixing pins or nails.

Figure 5:
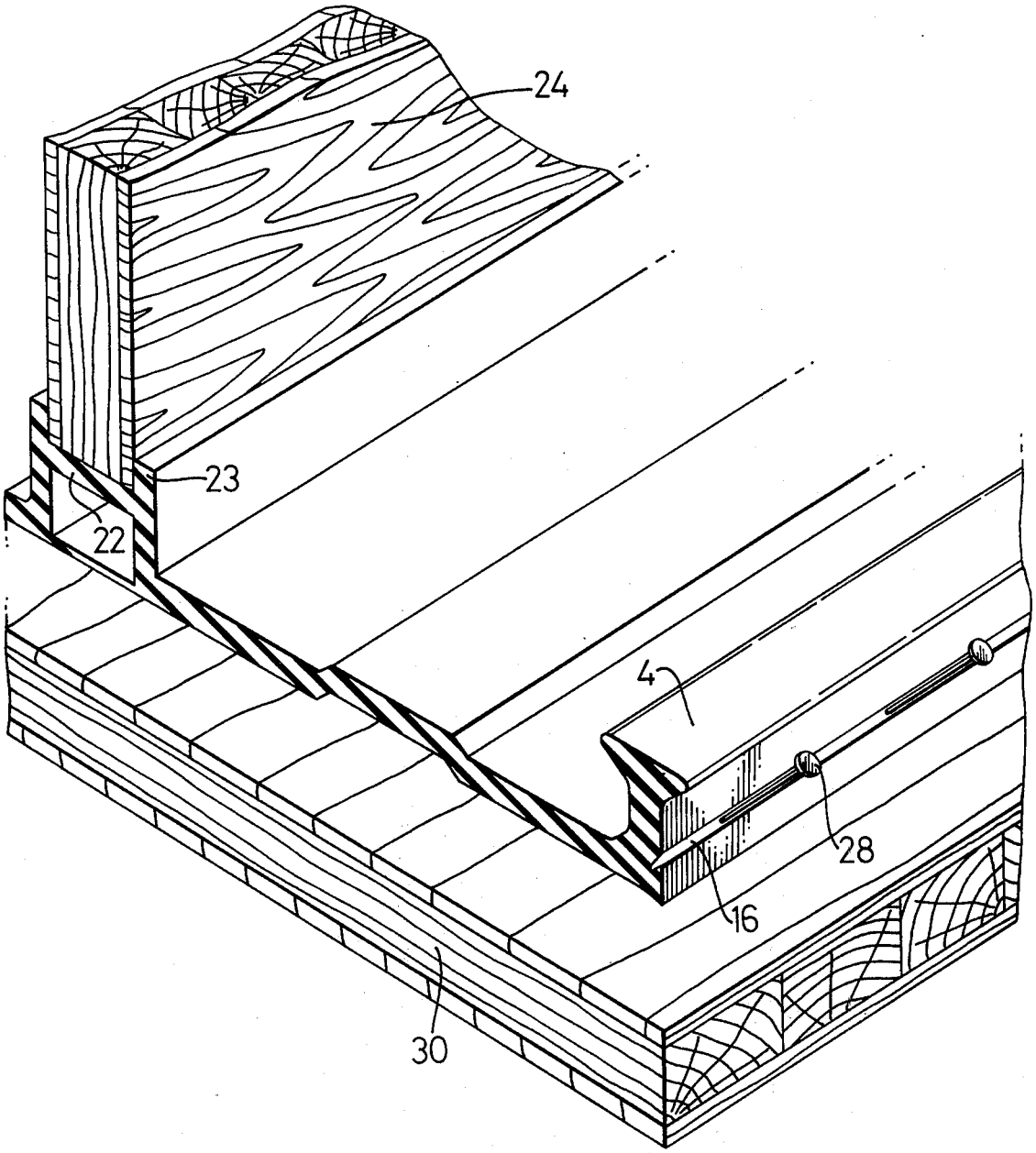
FIG. 5 shows a part perspective view of the waterstop of FIG. 1 with stop-end shuttering in position.

Referring to FIG. 1, a length of extruded strip for use as a waterstop is indicated generally at 1. The strip 1 comprises a generally flat base portion 2 having a raised central section 3 upstanding on one face thereof and two keying formations 4, 4' upstanding on the same face and at the lateral edges of the strip. The portions of the strip between the central section and the keying formation is known as a web portion.

The keying formations are of generally T-shaped section and broaden out from their root 5 to their top surface 6. It is also possible for the waterstop to have another part of keying formations between the central section 3 and the edges of the strip.

The web portion 2 is not completely flat but includes non-linear or raised portions 7, 7'. These allow some degree of stretching or contraction of the waterstop in use, thus permitting greater joint movement. As can be seen in FIG. 2, showing web variations 8, 9, 10 and 11, the raised portions can be of several different forms.

Referring now to FIG. 4 and particularly to the edge portions indicated at 12, which is an enlarged end view of part of the waterstop of FIG. 1, a corner of the strip is defined by the base surface 13 and a vertical wall 14 of the keying formation 4. Extending inwardly from the surfaces 13 and 14 are two collinear slots 15 and 16 which extend longitudinally along the strip (see main Figure). The corner 17 of the strip is thus peninsular in section. The slots 15 and 16 make an angle of 45° with the base of the strip and allow a plurality of nails, for example, to be easily inserted at this angle through the strip and into shuttering 30 or another surface (as seen in FIG. 5). It will be appreciated that it is not essential for the slots to be inclined at 45° to the base, and other acute angles could be used, preferably within the range of 30° - 60°.

This method of fixing may also utilise clips instead of nails and the variations indicated generally at 18 and 19 show that a strip may only have one or other of the slots 15 and 16 in order to locate clips 20 or 21. The clips themselves may be nailed or secured in any suitable way to the shuttering.

The central section 3 is preferably formed as a hollow section, but may be solid or may simply comprise an inverted U-shaped part of the base of the strip.

Preferably, the central section 3 is formed with means for locating stop-end shuttering. Thus in FIGS. 1 and 5, the section 3 comprises a raised flat portion 22 having upstanding side flanges 23, 23'. As seen in FIG. 2, the stop-end shuttering 24 is located between the flanges 23 and 23'.

A central section of this design, as well as providing a secure seating for the stop-end shuttering also acts as a grout seal and minimises the chance that a concrete slurry poured on one side of the stop-end shuttering leads past the shuttering through to the other side of the joint.

Some other changes of the central section are shown in FIG. 3 and are indicated generally at 25, 26, 27 and 29.

The method of using the waterstop according to the invention is illustrated in FIG. 5. The shuttering 30 forms the surface of the joint and may be of wood. Alternatively the joint surface may be a concrete base, in which case shotfired fixing pins may replace nails. Also the shuttering or concrete surface need not be horizontal but may be vertical.

As shown, the waterstop is laid in position on the shuttering or concrete surface and nails 28 are driven through the slot 16 at appropriate intervals, at an angle of 45° and into the shuttering. Normally, the head of the nail is not fully driven home so that the head makes an extra key with the concrete. The insertion of the nail at an angle of 45° ensures that the waterstop cannot easily lift away from the shuttering 30 but allows the shuttering to be more easily removed once the pour has been made.

The stop-end shuttering 24 is then located on the central section 22, normally at right angles to the shuttering 30. Concrete may then be poured into the spaces on one side of the stop-end shuttering and allowed to set. The stop-end is then removed and the other part of the concrete joint may be poured.

What is claimed is:

1. A surface water stop for forming a waterproof joint at the face of two pours of cementitious materials and adapted to be mounted on a supporting surface by fixing pins having a head thereon or clips, said water stop comprising:

a. a longitudinally extending strip of a selected width of rubber or plastic material having a base portion with at least a planar portion thereof adapted to be mounted on said supporting surface, said base portion having a longitudinally extending lower wall surface;

b. a longitudinally extending keying formation on each side of the center line of said base portion, each of said keying formations laterally extending from one face only of said base portion and having a side wall surface laterally extending transverse to the plane of said base portion; and c. longitudinally extending inclined guide slot located adjacent each longitudinal edge of said base portion in one of said lower and side wall surfaces, said slot having opposed, spaced-apart surfaces spaced laterally and widthwise along one of said side and lower wall surfaces respectively and arranged at an acute angle to said plane of said base portion for receiving and guiding said fixing pins or clips at said acute angle into said supporting surface for holding said said waterstop against said supporting surface and preventing said waterstop from moving relative to said fixing pins or clips and said supporting surface during pouring of said cementitious material.

2. The waterstop of claim 1 wherein said angle is 20° - 70°.

3. The waterstop of claim 1 wherein said acute angle is 30° - 60°.

4. The waterstop of claim 1 wherein each of said keying formations has a cross-section that is broader at the top than at the root thereof.

5. The waterstop of claim 1 wherein the base portion of the strip between said keying formations and said center line is non-linear in cross-section to permit expansion of said base portion.

6. The waterstop of claim 1 wherein the waterstop has a finite length and width, each of said fixing pins has a single head thereon, said guide slot extends along said length of said waterstop, said keying formations are located along each longitudinal edge of said base portion, and said slots extend substantially into said one of said side and lower wall surfaces.

7. A surface waterstop adapted to be mounted on a supporting surface by fixing pins having a head thereon or clips, said waterstop comprising:

a. a longitudinally extending strip of a selected width of rubber or plastic material having a base portion with at least a planar portion thereof adapted to be mounted on said supporting surface, said base portion having a longitudinally extending lower wall surface;

b. locating means adjacent the longitudinally extending central section of said base portion for locating and supporting stop-end shuttering;

c. a longitudinally extending keying formation on each side of the center line of said base portion, each of said keying formations laterally extending from one face only of said base portion and having a side wall surface laterally extending transverse to the plane of said base portion; and d. a longitudinally extending inclined guide slot located adjacent each longitudinal edge of said base portion in one of said lower and side wall surfaces, said slot having opposed, spaced-apart surfaces spaced laterally and widthwise along one of said side and lower wall surfaces respectively and arranged at an acute angle to said plane of said base portion for for receiving and guiding said fixing pins or clips at said acute angle into said supporting surface for holding said waterstop against said supporting surface and preventing said waterstop from moving relative to said fixing pins or clips and said supporting surface during pouring of said cementitious material.

8. The waterstop of claim 7 wherein said central section has a pair of parallel spaced apart edge flanges for locating said stop-end shuttering therebetween.

9. The waterstop of claim 7 wherein each of said keying formations has a cross-section which is broader at the top than at the root thereof.

10. The waterstop of claim 7 wherein said acute angle is 30° - 60°.

* * * * *